United States Patent [19]

Sepulveda et al.

[11] Patent Number: 4,537,237

[45] Date of Patent: Aug. 27, 1985

[54] LOUVERING OVERHEAD SECTIONAL DOOR

[75] Inventors: Frank J. Sepulveda; Robert R. Silva, both of San Jose, Calif.

[73] Assignee: Robert E. Reid, San Jose, Calif. ; a part interest

[21] Appl. No.: 561,123

[22] Filed: Dec. 12, 1983

Related U.S. Application Data

[63] Continuation of Ser. No. 283,089, Jul. 13, 1981.

[51] Int. Cl.[3] ..... E05D 15/06

[52] U.S. Cl. ..... 160/201; 160/116

[58] Field of Search ..... 160/32, 114, 115, 116, 160/129, 147, 180, 201, 219

[56] References Cited

U.S. PATENT DOCUMENTS

| | | | |
|---|---|---|---|
| 702,146 | 6/1902 | McCloud | 160/147 |
| 1,515,929 | 11/1924 | Clauerin | 160/116 |
| 2,083,467 | 6/1937 | Morris . | |
| 2,123,361 | 7/1938 | Hollis | 160/176 |
| 2,877,841 | 3/1959 | Grabove . | |
| 2,987,120 | 6/1961 | Greisser | 160/115 |
| 4,141,403 | 2/1999 | Church | 160/201 |

FOREIGN PATENT DOCUMENTS

| | | | |
|---|---|---|---|
| 1106629 | 12/1955 | France | 160/180 |
| 415775 | 11/1946 | Italy | 160/201 |
| 398038 | 2/1966 | Switzerland | 160/116 |

*Primary Examiner*—Peter M. Caun

*Attorney, Agent, or Firm*—Michael J. Pollock

[57] ABSTRACT

Our sectional overhead door is allowed to louver through machine mechanisms we have designed. The door louvers allowing ventilation, natural lighting, privacy, and security. These features can be utilized while the door is in the closed position, still allowing for the door to be raised in its normal manner. The louvering angle can be adjusted and locked by the use of one lever, thus allowing for maximum security while in the locked and louvered position. The bottom section will not louver for the purpose of additional security. Through the use of louvering, the above features can be achieved without changing the outward appearance of the structure.

8 Claims, 11 Drawing Figures

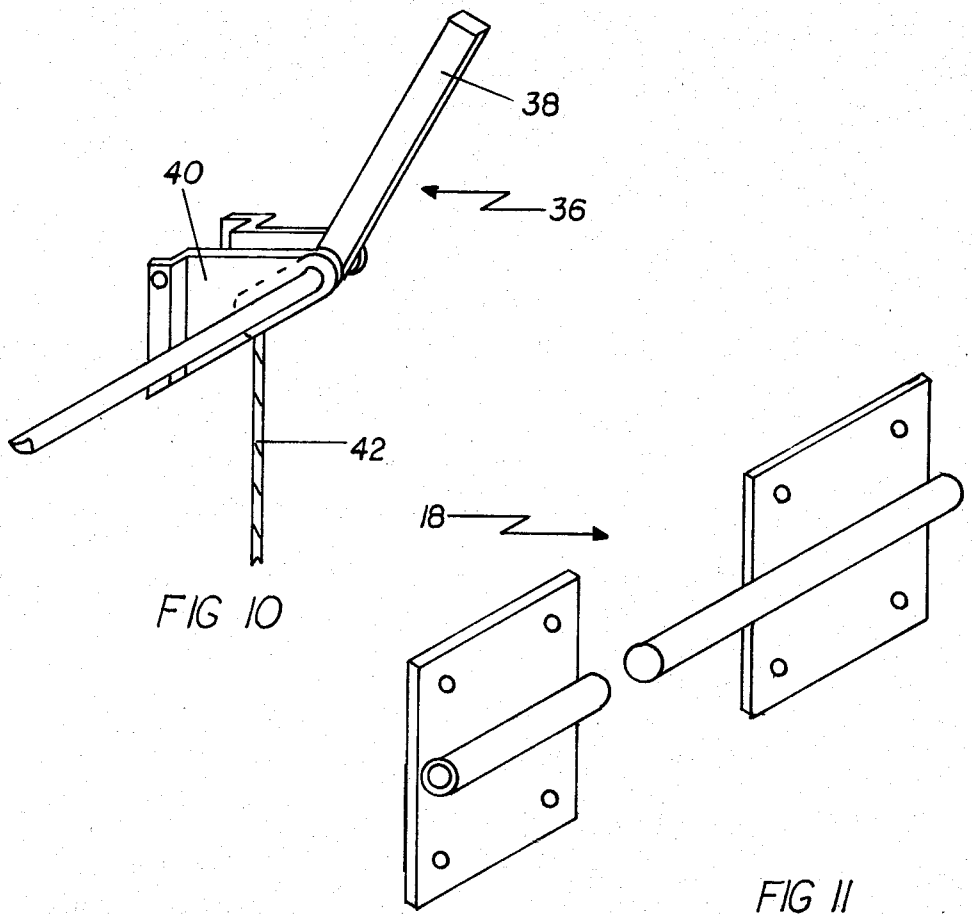
FIG 10
FIG 11
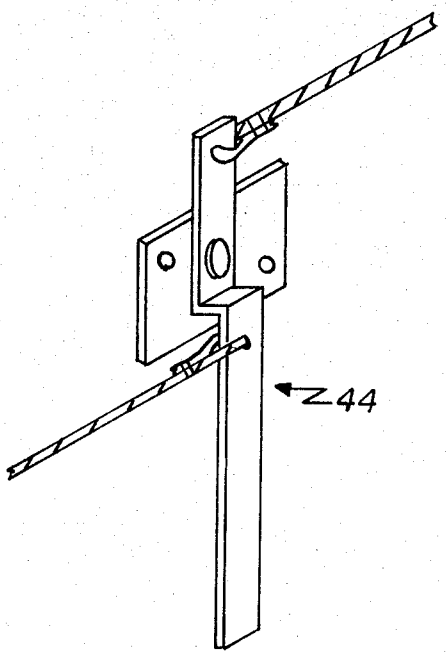
FIG 9

LOUVERING OVERHEAD SECTIONAL DOOR

This application is a continuation of application Ser. No. 283,089, filed July 13, 1981.

BACKGROUND OF THE INVENTION

1. Field of the Invention

The present invention relates to overhead sectional doors and, more particularly, to an overhead sectional door having louvering sections.

2. Discussion of the Prior Art

Overhead sectional doors are well known. The most common example of such a door is the conventional residential garage door. Typically, an overhead sectional garage door consists of a number of flat, relatively wide, wood or metal sections which are hinged together. Rollers attached to the sides of the sections engage a pair of guide tracks which are mounted one on each side of the garage opening. The tracks usually consist of a vertical portion which corresponds to the garage opening and an upper portion which follows the contour of the garage roof, usually at an angle of 90 degrees to the garage opening. Thus, the door may traverse the tracks from a fully-closed position with the door vertically disposed to a fully-open position with the door disposed along the upper portion of the track.

An overhead sectional door of the type just described serves two functions. It is either open to allow entry or it is closed to provide privacy and security. If ventillation or natural lighting are desired, the door must be open. When it is open, the contents of the structure are exposed to public scrutiny and the architectual esthetics of the structure are destroyed. If privacy and security are to be maintained, ventillation and natural light are lost.

Another type of device which is used, primarily in commercial applications, for closing a vertical opening is the rolling shutter. Rolling shutters typically consist of a large number of narrow slats. The slats engage a pair of vertical runners mounted on the sides of the opening. The upper end of each runner terminates in a roller device such that the shutter may be opened and closed in the manner of a window shade.

To facilitate this "window shade" operation, the slats which make up the shutter must be very narrow to allow them to negotiate the tight radius of the roller device. As a result, rolling shutters have no esthetic quality and are used primarily for security purposes.

SUMMARY OF THE INVENTION

It is an object of the present invention to provide an overhead sectional door which permits both the ventillation and the natural lighting of its associated structure while the security and esthetics of the structure are maintained.

Referring to FIGS. 1 and 2, a louvering overhead sectional door according to the present invention comprises a number of substantially-planar, articulatably-interconnected members 12. As shown in FIG. 3, the door 10 has means, e.g. roller assemblies 14, attached to it. The roller assemblies 14 engage a guide 16 mounted on a structure 100 in correspondence to a structural opening 102 such that the door 10 may traverse the guide 16 to open or close the opening 102. At least one of the planar members 12 comprises a center louvering section **12*a* which is pivotally attached to a pair of non-louvering end sections 12*b*. As shown in FIGS. 3, 4 and 5, a louvering mechanism is attached to the louvering section 12*a* for pivoting the louvering section 12*a* out of the plane of its corresponding planar member 12**.

Other features and advantages of the present invention may be ascertained from the following description of a preferred embodiment considered in conjunction with the accompanying drawings.

BRIEF DESCRIPTION OF THE DRAWINGS

FIG. 9 is an illustration of an embodiment of a release lever for a louver position lock.

FIG. 10 is an illustration of an embodiment of a section lock release mechanism.

FIG. 11 is an illustration of an embodiment of a section pivot assembly.

DETAILED DESCRIPTION OF A PREFERRED EMBODIMENT

Figure 1:
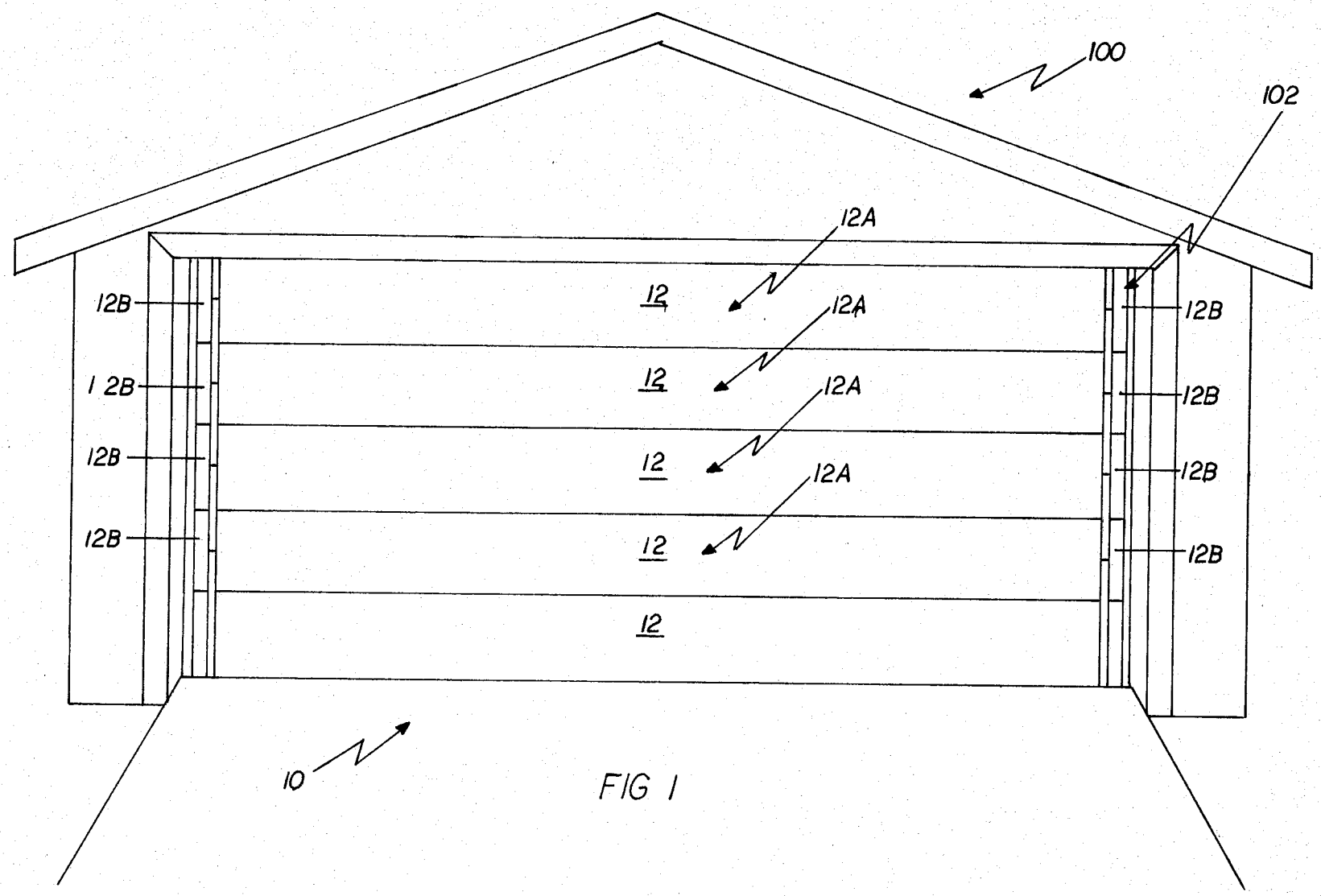
FIG. 1 is an elevational view of a louvering overhead sectional door, the door being disposed in the closed position with louvering sections locked in the plane of corresponding planar members.
Figure 2:
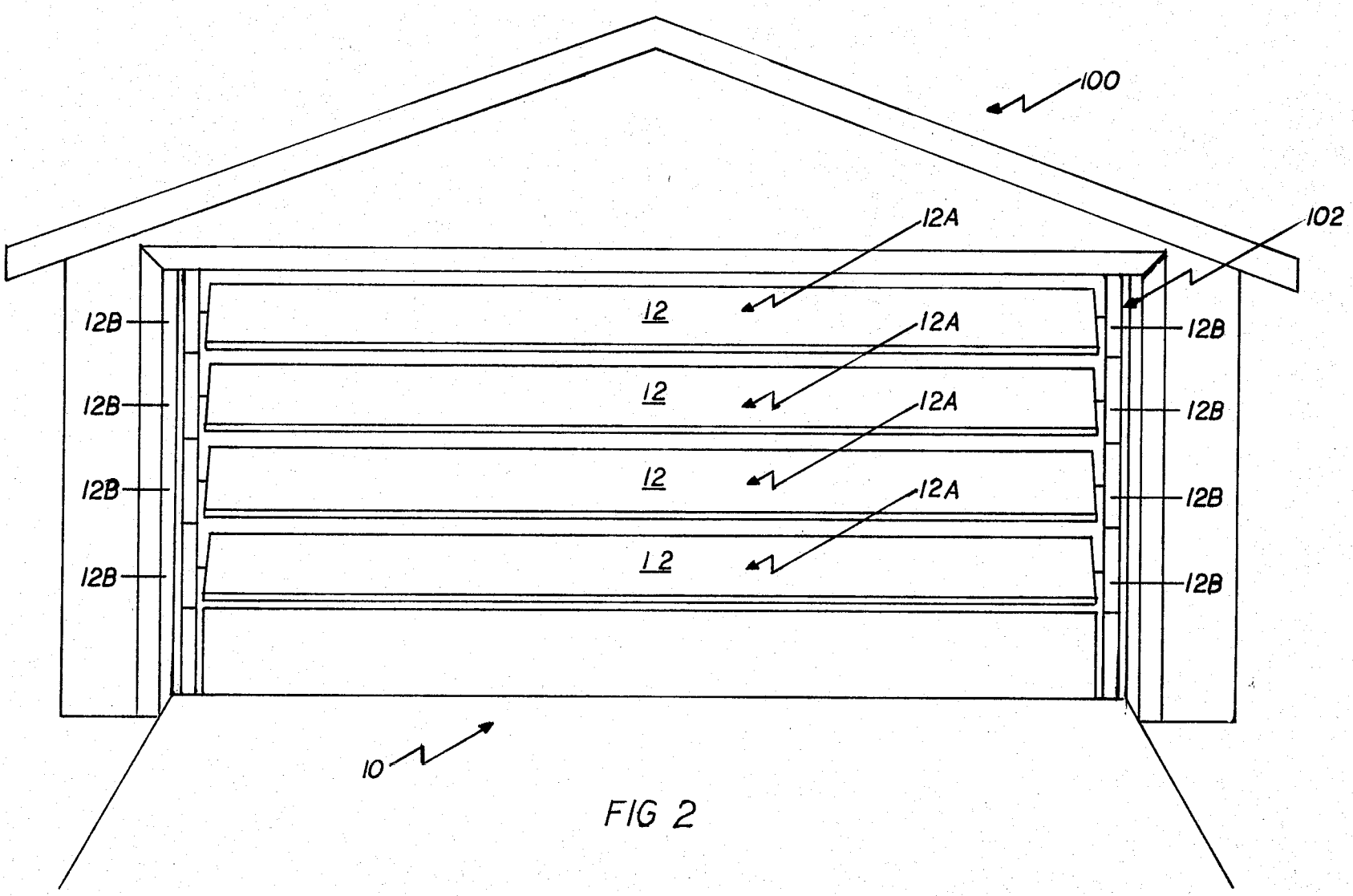
FIG. 2 is an elevational view of a louvering overhead sectional door, the door being disposed in the closed position with louvering sections pivoted out of the plane of corresponding planar members.

Referring again to FIGS. 1 and 2, according to a preferred embodiment of the present invention, a louvering overhead sectional door 10 of the type utilized to close a vertical opening 102 in a structure 100 includes a number of wood or metal, substantially-planar, articulatably-interconnected members 12. At least one, and as illustrated preferably a number of adjacent planar members 12 consist of a center louvering section **12*a* pivotally connected to a pair of non-louvering end sections 12*b***.

Figure 3:
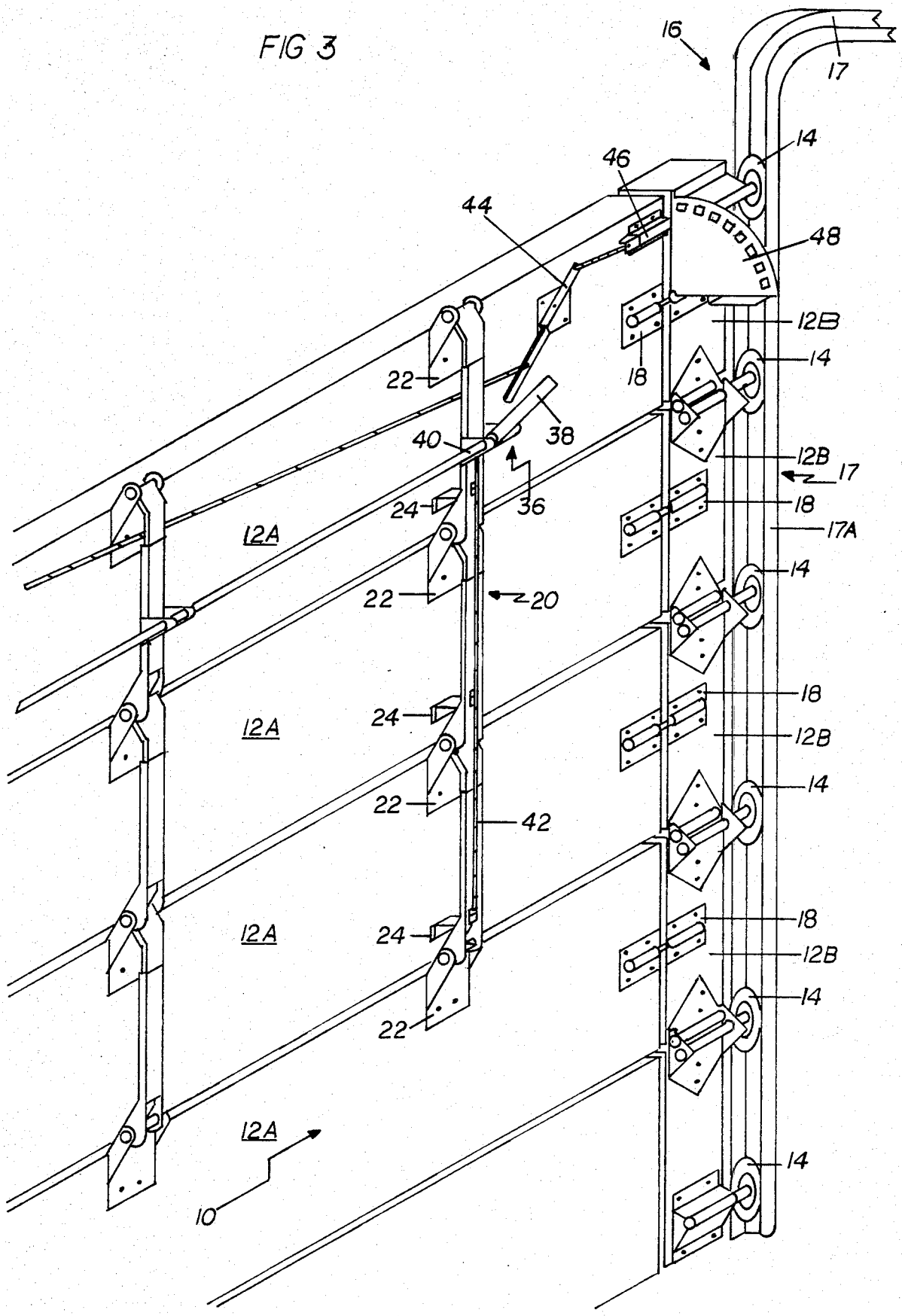
FIG. 3 is a perspective view, from inside a structure, of the door of FIGS. 1 and 2.

As shown in FIG. 3, a section pivot assembly 18 forms the interconnection between a center louvering section **12*a* and its corresponding pair of non-louvering end sections 12*b*. A more detailed illustration of a section pivot assembly is provided in FIG. 11**.

As further shown in FIG. 3, the door 10 has roller assemblies 14 attached to it. The roller assemblies 14 engage a guide means 16 which is mounted in correspondence to the opening 102 such that the door 10 may traverse the guide means 16 to open and close the structural opening 102. In the illustrated embodiment, the roller assemblies 14 include hinges which are attached to the door 10 such that the planar members 12 are articulatably interconnected.

FIG. 3 also shows a guide means 16 which includes a pair of guide tracks 17, one guide track 17 being mounted on the structure 100 at each side of the vertical opening 102. Each guide track 17 includes a vertical portion **17*a* and a portion 17*b* which is disposed at an angle to the vertical portion 17*a*. In the illustrated embodiment, the portion 17b is disposed at an angle of 90 degrees to the vertical portion 17a**.

As further shown in FIG. 3, a louvering mechanism is attached to each louvering section 12a for pivoting each louvering section 12a out of the plane of its corresponding planar member 12. In the illustrated embodiment, the louvering mechanism includes a pair of spaced apart hinge assemblies 20 (only one of which is shown), each hinge assembly including a number of rigidly interconnected hinges 22, one such hinge 22 being attached to the upper edge of a corresponding louvering section 12a. An equal number of section locks 24 are attached to each of the louvering sections 12a for locking the louvering sections 12a into the plane of its corresponding planar member 12. In the illustrated embodiment, the number of section locks 24 corresponds to the number of hinges 22 and one section lock 24 is mounted at the lower edge of each louvering section 12a such that each hinge 22 engages a corresponding section lock 24 to lock the louvering sections 12a.

Figure 6:
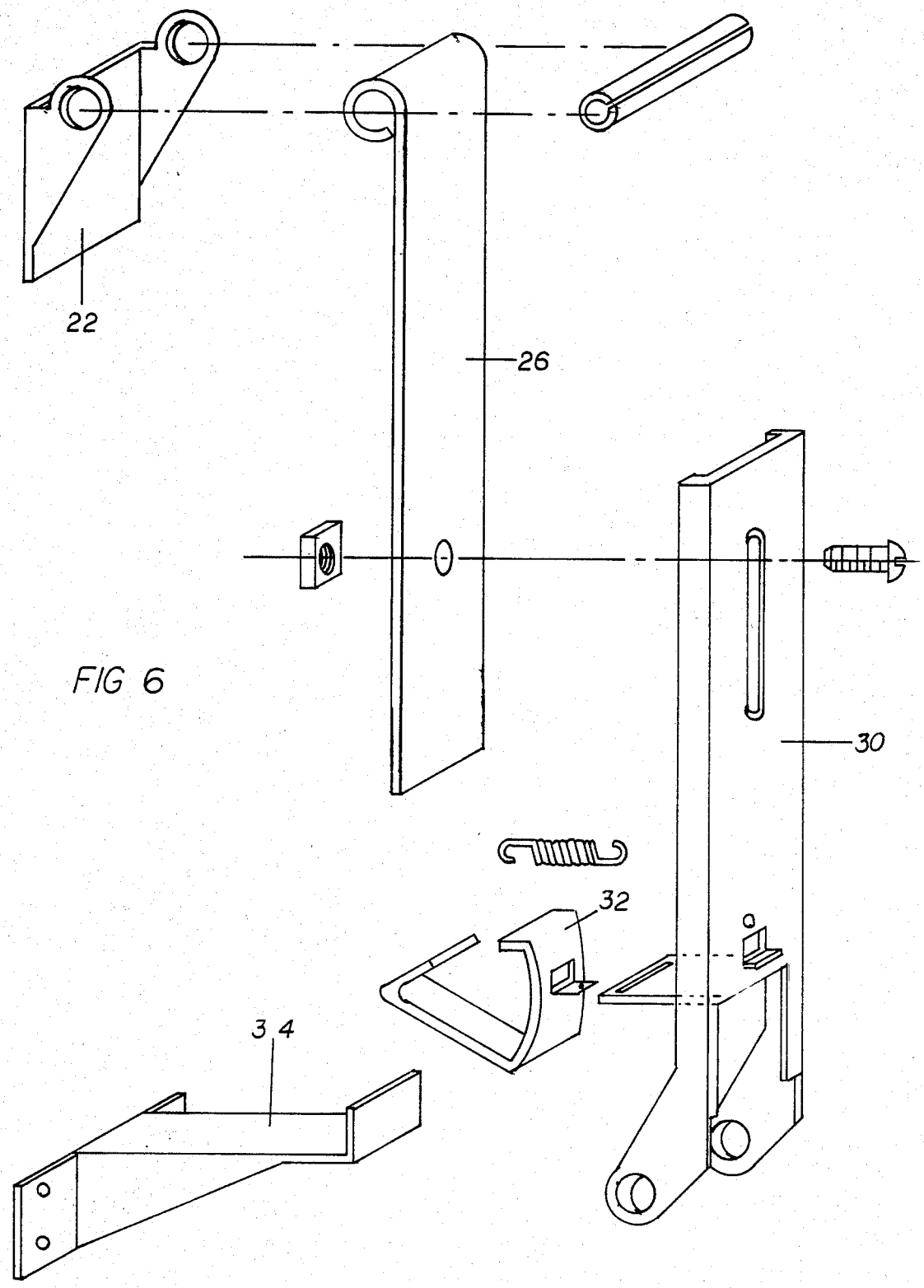
FIG. 6 is an exploded illustration of an embodiment of a portion of a hinge assembly.
Figure 8:
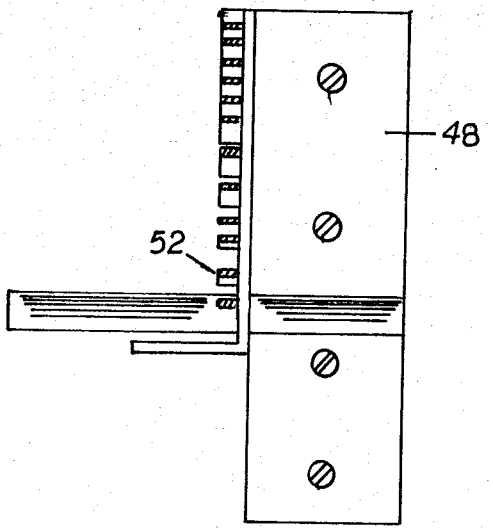
FIG. 8 is a front elevation view of the louver position lock mechanism of FIG. 7.
Figure 7:
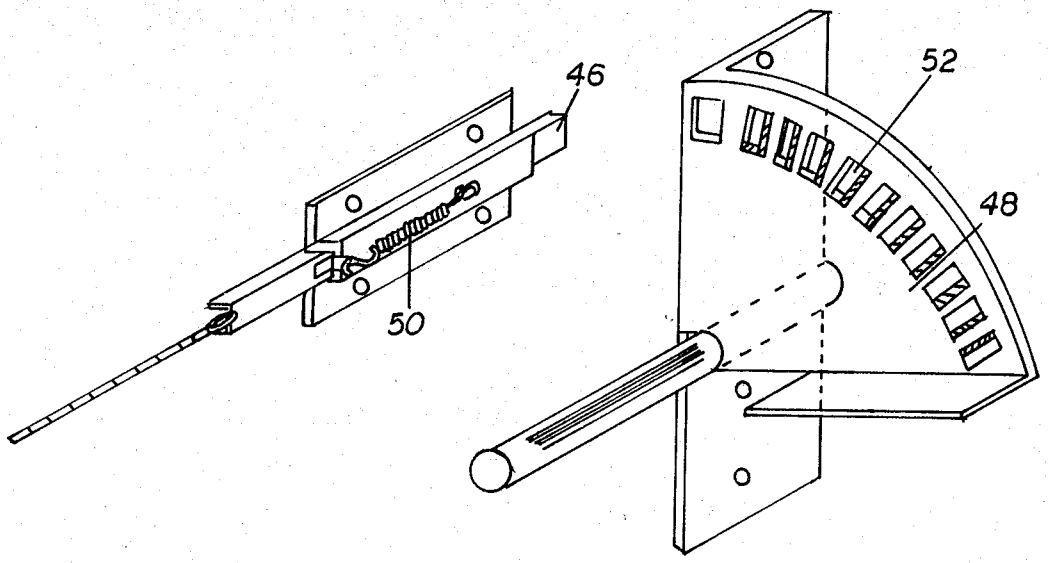
FIG. 7 is an oblique view of an embodiment of a louver position lock mechanism.

A hinge 22 and section lock 24 combination as illustrated in FIG. 3 is shown in exploded detail in FIG. 6. The hinge 22 shown in FIG. 6 consists of a metal strap 26 which pivotally engages a bracket 28 which is mounted at the upper edge of a louvering section 12a. The strap 26 is adjustably fastened to a hinge body 30. The section lock 24 consists of a spring loaded locking cam 32 which rotatably engages the hinge body 30. A locking tab 34 is mounted at the bottom edge of the corresponding louvering section 12a such that the locking cam 32 will cam up and over the vertical tab 34a on the locking tab 34 to lock the louvering sections 12a in a non-louvering position.

Figure 4:
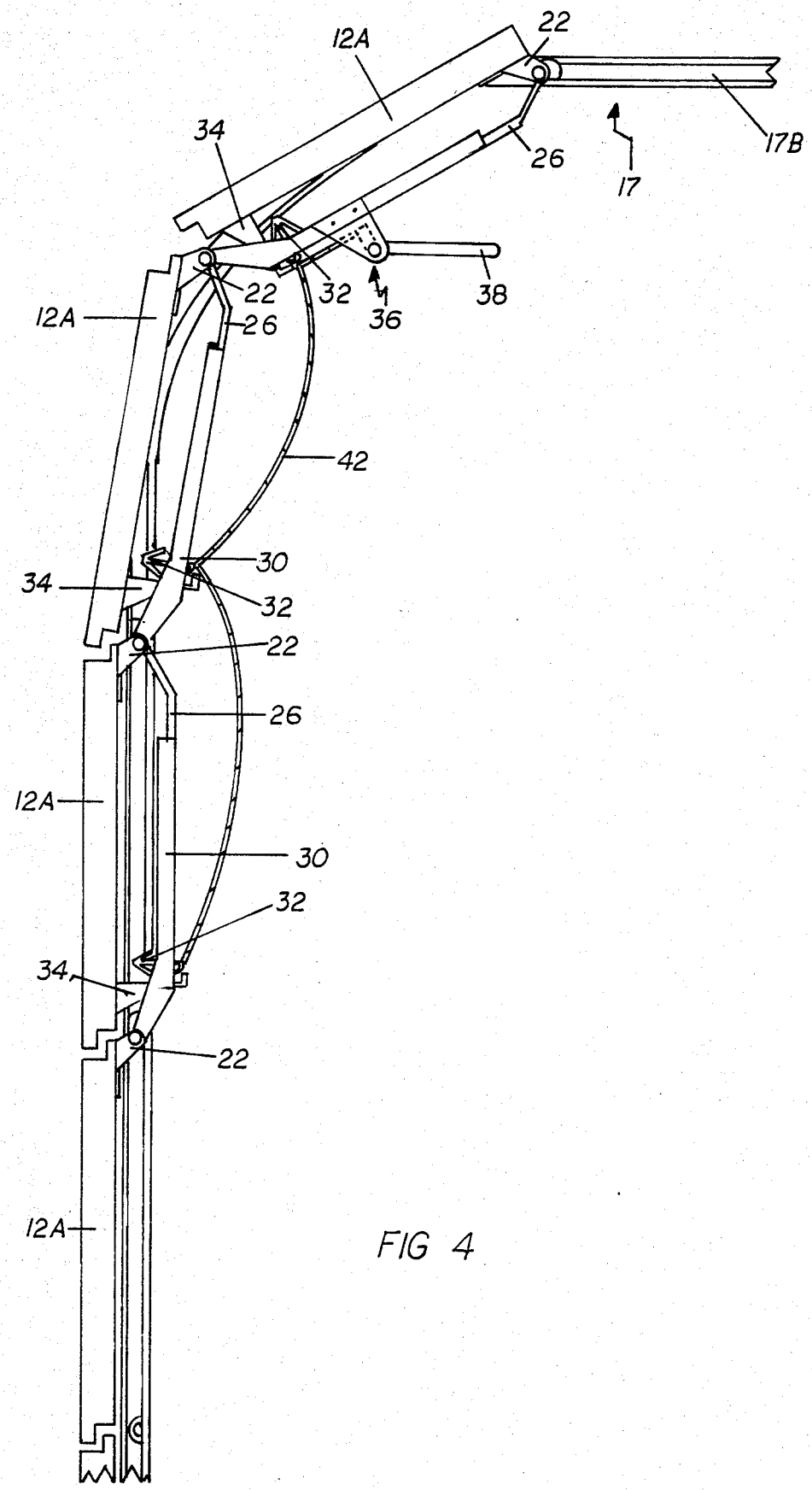
FIG. 4 is a side elevation of the door of FIG. 3 with louvering sections in a locked position.
Figure 5:
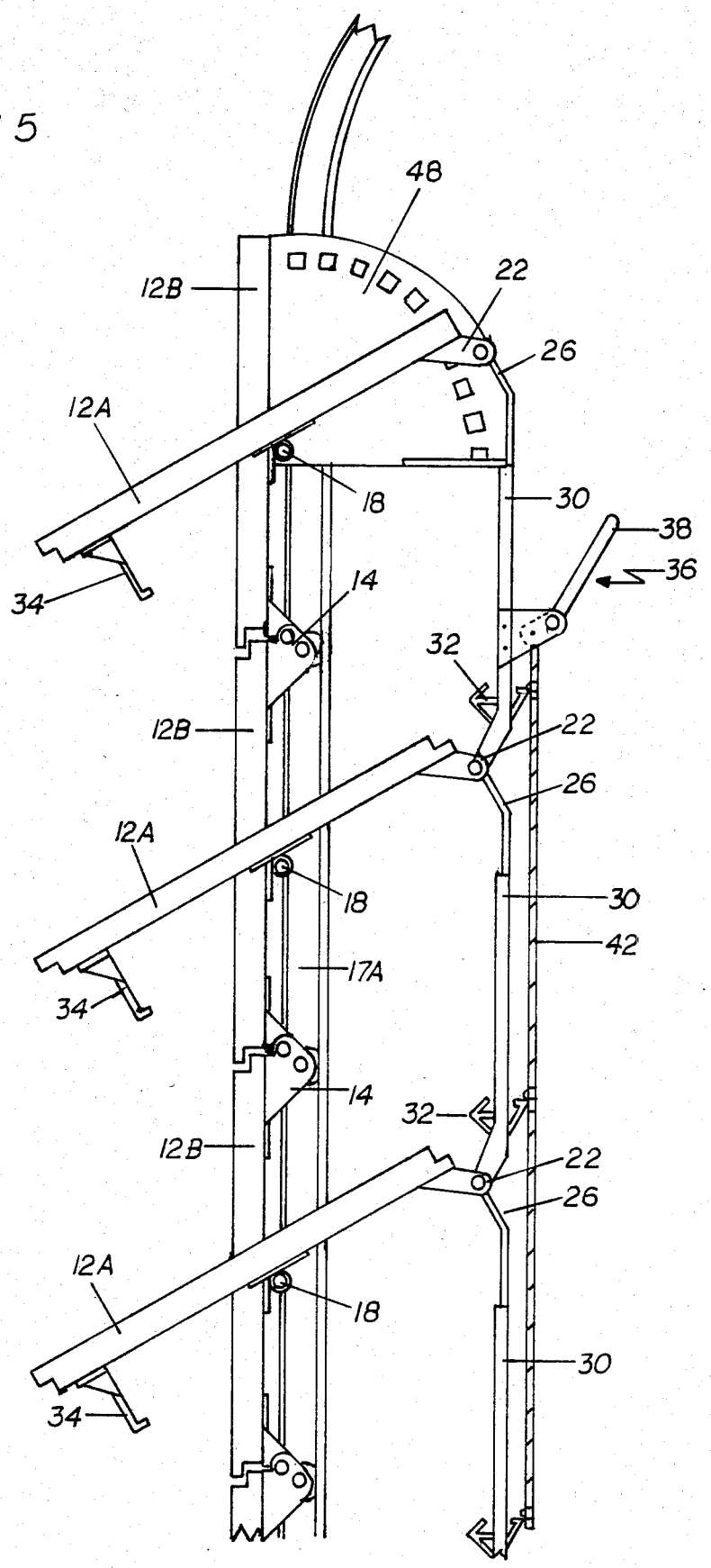
FIG. 5 is a side elevation of the door of FIG. 3 with louvering sections in a pivoted position.

To unlock the louvering sections 12a, a section lock release mechanism 36, a preferred embodiment of which is illustrated in FIGS. 3, 4 and 5 and is shown in detail in FIG. 10, is mounted on the door 10 and connected to the section locks 24 for simultaneously releasing the section locks 24 such that the louvering sections 12a may pivot out of the plane of their corresponding planar members 12.

As illustrated, the section lock release mechanism 36 includes a handle 38 mounted on a release mechanism bracket 40 which is attached to the hinge assembly 20. A cable 42 is attached to the handle 38 at one of its ends and to each of the section locks 24 along its length such that when the handle 38 is pulled, the cable 42 acts on the locks 24 to simultaneously release them.

Once the locks 24 have been released, a louvering position lock handle 44, which is mounted on a louvering section 12a and is illustrated in FIGS. 3 and 9, is pulled to cause a louvering lock bolt 46 mounted on the same section 12a to clear a louvering lock plate 48 mounted on an adjacent end section 12b. When a desired angle of pivot has been selected, handle 44 is released to allow bolt 46, which is under the tension of spring 50, to enter a desired louver position slot 52 in plate 48.

To return the louvering sections 12a to the non-louvering, locked position, the bolt 46 is disengaged from plate 48 by the action of handle 44.

The description provided above should not be construed as a limitation on the scope of the present invention, but rather as an example of a preferred embodiment. Many other variations are possible and will be obvious to those skilled in the art. Accordingly, the scope of the present invention should not be determined by the preceding description, but by the appended claims and their equivalents.

We claim:

1. A louvering overhead sectional door assembly such as that utilized to close a vertical opening in a structure, the assembly including a door comprising a plurality of substantially planar, articulatably interconnected members and having means attached thereto for engaging a guide means mounted in correspondence to the opening such that the door may traverse the guide means to open and close the opening, said assembly characterized by (a) each of a plurality of adjacent substantially planar members comprising a center louvering section pivotally attached to a pair of non-louvering end sections;

(b) louvering means attached to each of the center louvering sections for pivoting the center louvering sections when the door is vertically disposed, the louvering means comprising a pair of hinge assemblies, each hinge assembly comprising interconnected hinges, one such hinge being attached to a corresponding center louvering section;

(c) a plurality of releasable section locks, at least one such lock being attached to each center louvering section for locking the center louvering section into the plane of its corresponding planar member; and (d) section lock release means operatively connected to the section locks for simultaneously releasing the section locks such that each of the center louvering sections may pivot out of the plane of its corresponding planar member.

2. A louvering overhead sectional door assembly as in claim 1 wherein the guide means comprises a pair of spaced apart guides, each guide having a vertical portion and a portion disposed at an angle to the vertical portion such that the door may traverse the guides from a fully-closed position wherein the door is substantially vertically disposed to a fully-open position wherein the door is disposed in correspondence to the portion of the guides disposed at an angle to the vertical portions.

3. A louvering overhead sectional door assembly as in claim 1 wherein the center louvering sections are simultaneously pivotable to the same degree.

4. A louvering overhead sectional door assembly as in claim 3 further including pivot locking means operatively connected to the louvering means for locking the center louvering sections at a desired angle of pivot.

5. A louvering overhead sectional door assembly such as that utilized to close a vertical opening in a structure, the assembly including a door comprising a plurality of substantially planar, articulatably interconnected members and having means attached thereto for engaging a guide means mounted in correspondence to the opening such that the door may traverse the guide means to open and close the opening, said assembly characterized by (a) multiple of the planar members comprising a center louvering section pivotally attached to a pair of non-louvering end sections;

(b) louvering means attached to each of the center louvering sections for pivoting the center louvering sections when the door is vertically disposed;

(c) at least one releasable section lock attached to each center louvering section for locking such center louvering section into the plane of its corresponding planar member; and (d) section lock release mechanisms, one such mechanism connected to each section lock for releasing such section lock such that the center louvering section to which such section lock is attached may pivot out of the plane of its corresponding planar member.

6. A louvering overhead sectional door assembly as in claim 5 wherein the louvering means comprises at least two hinge assemblies, each hinge assembly comprising interconnected hinges, at least one such hinge being attached to a corresponding center louvering section.

7. A louvering overhead sectional door assembly such as that utilized to close a vertical opening in a structure, the assembly including a door comprising a plurality of substantially planar, articulatably interconnected members and having means attached thereto for engaging a guide means mounted in correspondence to the opening such that the door may traverse the guide means to open and close the opening, said assembly characterized by:

(a) each of a plurality of the substantially planar members comprises a center louvering section pivotally attached to a pair of non-louvering end sections;

(b) louvering means attached to each of the center louvering sections for pivoting the center louvering sections when the door is vertically disposed;

(c) a plurality of releasable section locks, at least one such lock being attached to each center louvering section for locking the center louvering section into the plane of its corresponding planar member; and (d) a plurality of section lock release mechanisms, one such mechanism operatively connected to each section lock for releasing the section lock such that the center louvering section to which such lock is attached may pivot out of the plane of its corresponding planar member.

8. A louvering overhead sectional door assembly as in claim 7 wherein said section locks are independently releasable.

* * * * *